US005894805A

United States Patent [19]

Raasch et al.

[11] Patent Number: 5,894,805

[45] Date of Patent: Apr. 20, 1999

[54] SELECTIVE VERTICAL LOCKING MECHANISM FOR TELESCOPING TUBES

[75] Inventors: Jason J. Raasch, Arlington Heights; Andrey E. Frolov, Glenview, both of Ill.

[73] Assignee: Midwest Air Technologies, Inc., Wheeling, Ill.

[21] Appl. No.: 09/016,202

[22] Filed: Jan. 30, 1998

[51] Int. Cl.[6] ..... A47B 9/00

[52] U.S. Cl. ..... 108/146; 108/147.19

[58] Field of Search ..... 108/144.11, 146, 108/147.19, 148; 248/188.5, 412, 157, 411

[56] References Cited

U.S. PATENT DOCUMENTS

| | | | |
|---|---|---|---|
| 2,364,191 | 12/1944 | Campbell | 108/148 |
| 3,737,136 | 6/1973 | Snurr | 108/147.19 X |
| 3,853,297 | 12/1974 | Drolet | 108/147.19 X |
| 3,976,016 | 8/1976 | Longbottom | 108/148 X |
| 3,999,492 | 12/1976 | Emrick | 108/146 |
| 4,195,578 | 4/1980 | Benoit et al. | 108/146 X |
| 4,434,722 | 3/1984 | Solomon et al. . | |
| 4,492,170 | 1/1985 | Solomon . | |
| 4,601,246 | 7/1986 | Damico . | |
| 4,607,577 | 8/1986 | Leonardo | 108/146 |
| 5,016,846 | 5/1991 | Solomon . | |
| 5,106,043 | 4/1992 | Solomon . | |

FOREIGN PATENT DOCUMENTS

| | | | |
|---|---|---|---|
| 121757 | 5/1948 | Sweden | 108/148 |

*Primary Examiner*—Jose V. Chen
*Attorney, Agent, or Firm*—Greer, Burns & Crain, Ltd.

[57] ABSTRACT

A selective vertical locking mechanism is provided for use with a pair of telescoping tubes. A locking mechanism releasably locks the inner tube relative to the outer tube for adjustment of table height. The locking mechanism includes a housing disposed at the lower end of the inner tube. A locking element with the housing is biased against an inclined ramp fixed within the housing and, though an opening in the housing, against the inner wall of the outer tube, thereby preventing the inner tube from moving downwardly within the outer tube. A push rod and arm, actuated by a handle near the platform, pushes the locking element away from the inner wall or the ramp which allows the inner tube to move downwardly.

23 Claims, 3 Drawing Sheets

SELECTIVE VERTICAL LOCKING MECHANISM FOR TELESCOPING TUBES

BACKGROUND OF THE INVENTION

This invention relates generally to devices incorporating telescoping tubes having adjustable relative lengths, and specifically to a mechanism for selectively locking the relative positions of a pair of telescoping tubes for providing a combined tubular assembly of differing lengths.

The present type of adjustable tubular assembly is found in a variety of consumer products. One such product is a medical table such as an overbed table with vertical adjustability. However, it is contemplated that the present invention may be used in other products, and is not restricted to overbed tables.

Overbed tables are widely used in hospitals, nursing homes, and the like. It is desirable that the tables be vertically adjustable in order to accommodate beds and chairs of varying heights. Typically, an overbed table consists of a pair of telescoping tubes mounted on a movable stand and having a horizontal tabletop surface mounted to one of the tubes. The height of the table is determined by the relative positions of the tubes between a retracted position and an extended position. The tubes can be locked at, and released from, numerous positions. Several mechanisms for locking a table at a selected height are known in the art.

One such locking mechanism is shown in U.S. Pat. No. 4,601,246 to Damico. This mechanism employs a wedge and roller clutch mechanism to lock a pair of vertically telescoping tubes. However, this mechanism employs two wedges and at least one and preferably two rollers and, without expensive precision manufacturing of these pieces, it is difficult to make both rollers "grab" simultaneously during adjustment of the height of the table. This results in an echo effect—the second roller grabbing after the first—while attempting to lock the table at the selected height, which tends to hinder precise adjustment of the height. Furthermore, this type of adjustment results in a rough and uneven movement of the tubes relative to each other.

U.S. Pat. Nos. 5,016,846 and 5,106,043 to Solomon provide for a cam plate type locking mechanism with a single locking plate pivotally mounted to the inner telescoping tube. To lock the inner tube to the outer tube, a spring forces this plate into contact with an interior surface of the outer tube. After repeated uses of the mechanism, the interior surface of the outer tube has numerous dents caused by the locking plate. Hence, operation of the table becomes noisy and operation of the release mechanism may require considerable force.

Accordingly, it is the primary object of the present invention to provide an improved selective locking mechanism for a pair of telescoping tubes which provides for precision adjustment of the relative position of the two tubes.

It is another object of the present invention to provide an improved overbed table with a selective locking mechanism employing a pair of telescoping tubes, the locking mechanism configured for silent and smooth adjustment of table height.

It is a further object of the present invention to provide an improved overbed table with a selective locking mechanism that is easily released.

BRIEF SUMMARY OF THE INVENTION

The above identified objects are met or exceeded by the present vertical locking mechanism for a pair of telescoping tubes. The present locking mechanism features a single, generally cylindrical locking element located in a locking chamber so that it can be wedged against an internal ramp and an inner surface of the outer telescoping tube to lock the position of the inner tube relative to the outer tube. A coiled spring biases the locking element so that the locking action is achieved smoothly and positively. In addition, the sliding action of the inner tube relative to the outer table is relatively smooth due to bearing surfaces provided by the mechanism. To release the telescoping tubes from the locked position, a push rod is connected to a pivot arm which is pivotally and positively secured to the locking element housing. A second, constant force spring is provided to bias the inner tube to an extended, rather than a retracted telescoped position.

More specifically, the present invention provides a locking mechanism for locking the relative position of an inner tube and an outer tube between a retracted position and an extended position and includes a housing fixed to a first end of the inner tube. The outer tube has an inner wall and the housing has an opening adjacent the inner wall. An inclined ramp fixed in the housing, and a portion of the inner wall adjacent the opening, define a generally wedge-shaped locking chamber with a wide end and an narrow end. A locking element disposed within the chamber contacts the ramp and, through the opening, the inner wall to prevent the inner tube from sliding in one direction within the outer tube. A biasing device disposed in the chamber urges the locking element against the ramp and the inner wall. Another feature includes a user actuated push rod connected to a pivot arm secured to the housing for positively disengaging the locking element from either the ramp or the inner wall to allow the inner tube to move within the outer tube. In the preferred embodiment, the locking element is a cylindrical roller.

In another embodiment, the present invention provides a medical table including a stand, an outer tube mounted to the stand and an inner tube slidably engaged with the outer tube. A platform is mounted to an upper portion of the inner tube. A locking assembly locks the inner and outer tubes relative to each other and prevents the platform from moving downward. A release mechanism includes a push rod actuated by a handle which is pivotal about an axis in operational relationship with the upper end of the inner tube. The actuation of the handle causes the push rod to move an arm, pivotal about an axis within the housing, to push the locking element away from the inner wall or the ramp. The inner tube is biased to the extended position by a constant force spring.

DETAILED DESCRIPTION OF THE INVENTION

Figure 1:
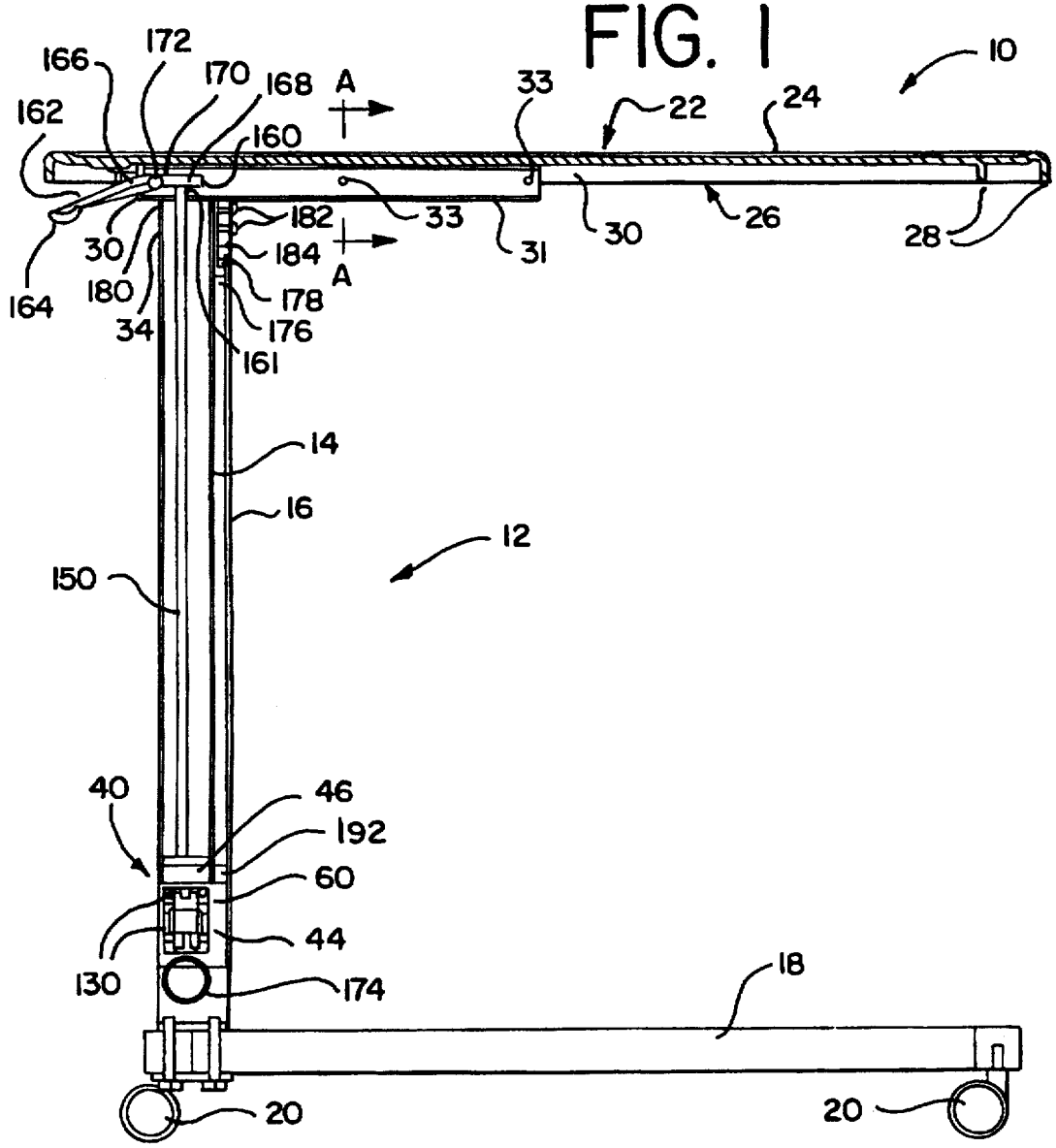
FIG. 1 is an elevational side view of a medical table incorporating the present locking mechanism with portions shown cut away for clarity.
Figure 1A:
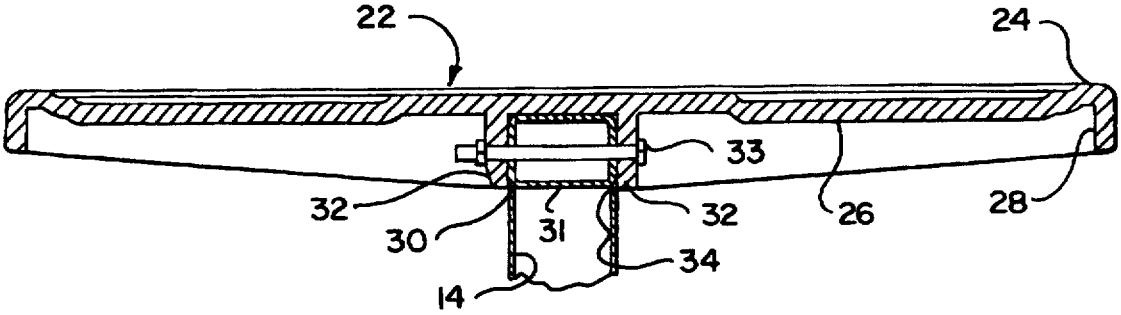
FIG. 1A fragmentary sectional view of the table of FIG. 1 taken along the line A—A of FIG. 1 and in the direction generally indicated.
Figure 5:
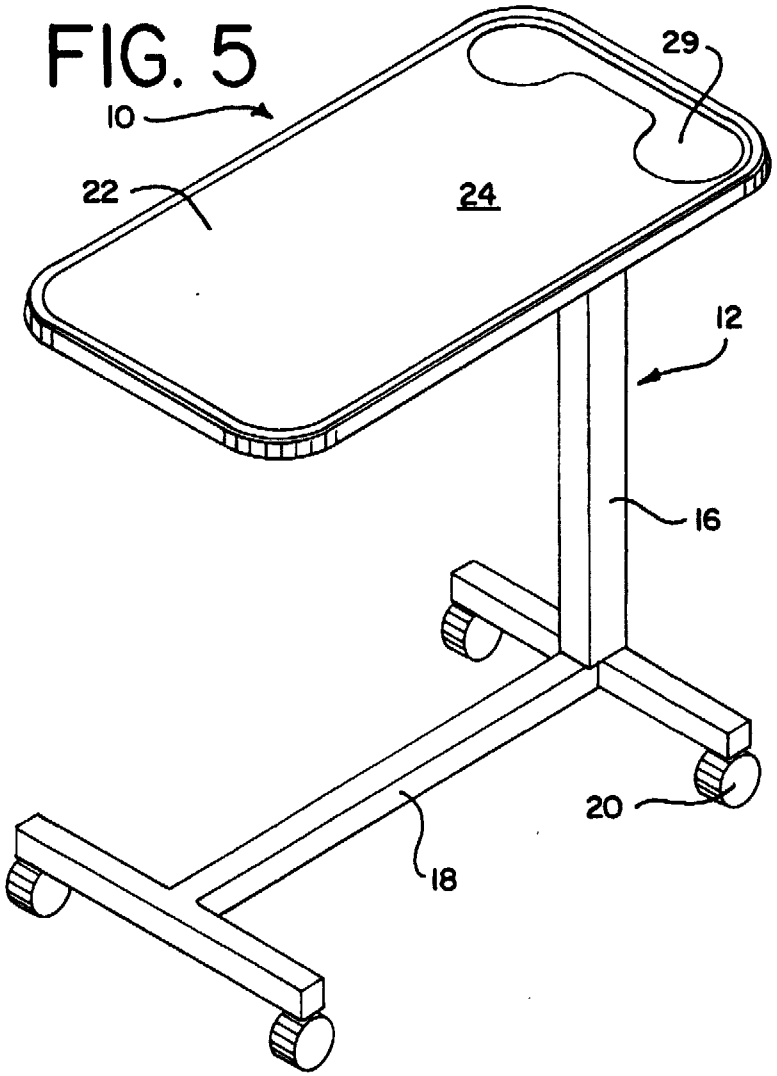
FIG. 5 is a top perspective view of a medical overbed table incorporating features of the invention.

Referring now to FIGS. 1A, 1 and 5, a medical-type overbed table of the type which is suitable for incorporating the present invention is shown and generally designated as 10. Included in the table 10 is a pair of telescoping tubes, designated generally as 12, including an inner tube 14 slidably engaged in outer tube 16. It is contemplated that the inner tube 14 and the outer tube 16 are rectangular steel stock tubing. However, it should be understood that a variety of alternate shapes and tubing materials may be used including bent formed steel. The outer tube 16 is welded or otherwise rigidly fastened to a stand or base 18. Casters 20, mounted beneath the stand 18, allow for the table 10 to be rollable about the floor of a room.

A rigid platform, generally designated as 22, includes an upper tabletop surface 24, and an undersurface 26 having a number of intersecting, depending ribs 28 which provide support and rigidity to the platform 22. In the preferred embodiment, the platform 22 is made of injection molded plastic, however other types of rigid plastics or metals are contemplated. In the preferred embodiment, the upper surface 24 is provided with at least one integrally formed recess 29 for the retention of articles, such as bowls, drinking glasses, medicine bottles, etc. It will be seen that the present recess has a pair of generally circular portions in communication with each other. However, it is contemplated that other shapes are feasible depending on the application. An inverted mounting channel 30 includes a pair of rigid sidewalls 32 and depends from the undersurface 26 (best seen in FIG. 1A). The shape and size of the mounting channel 30 is determined by the cross-sectional shape and size of the inner tube 14, as well as a corresponding platform support tube 31 which is secured at a right angle to an upper end 34 of the inner tube 14, as by welding. Fasteners 33 secure the platform 22 to the support tube 31. It will be seen from FIG. 1 that the mounting channel 30 is disposed on the platform 22 in an offset position so that the table top surface 24 is supported on the tubes 12 in a cantilevered manner. Depending on the application, other relative positions of the channel 30 and the platform 22 may be provided.

Figure 3:
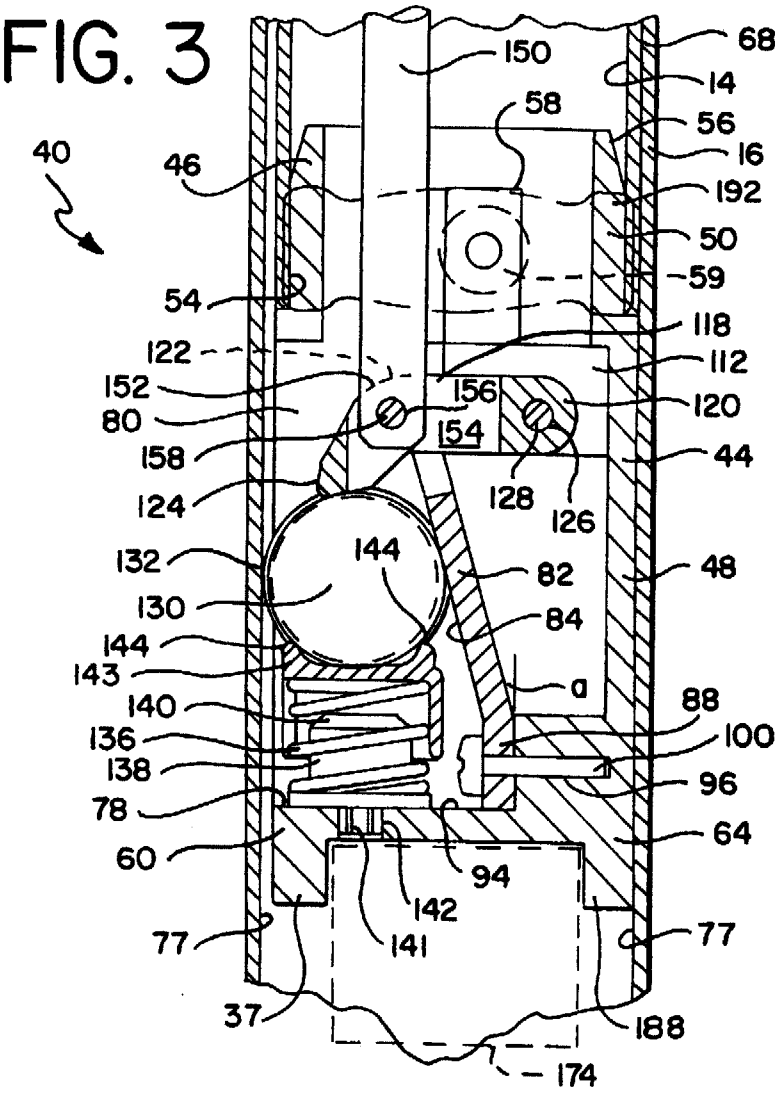
FIG. 3 is a cross-sectional view of the present locking mechanism taken along the line 3—3 of FIG. 2 and in the direction generally indicated, shown assembled in a pair of telescoping tubes.
Figure 2:
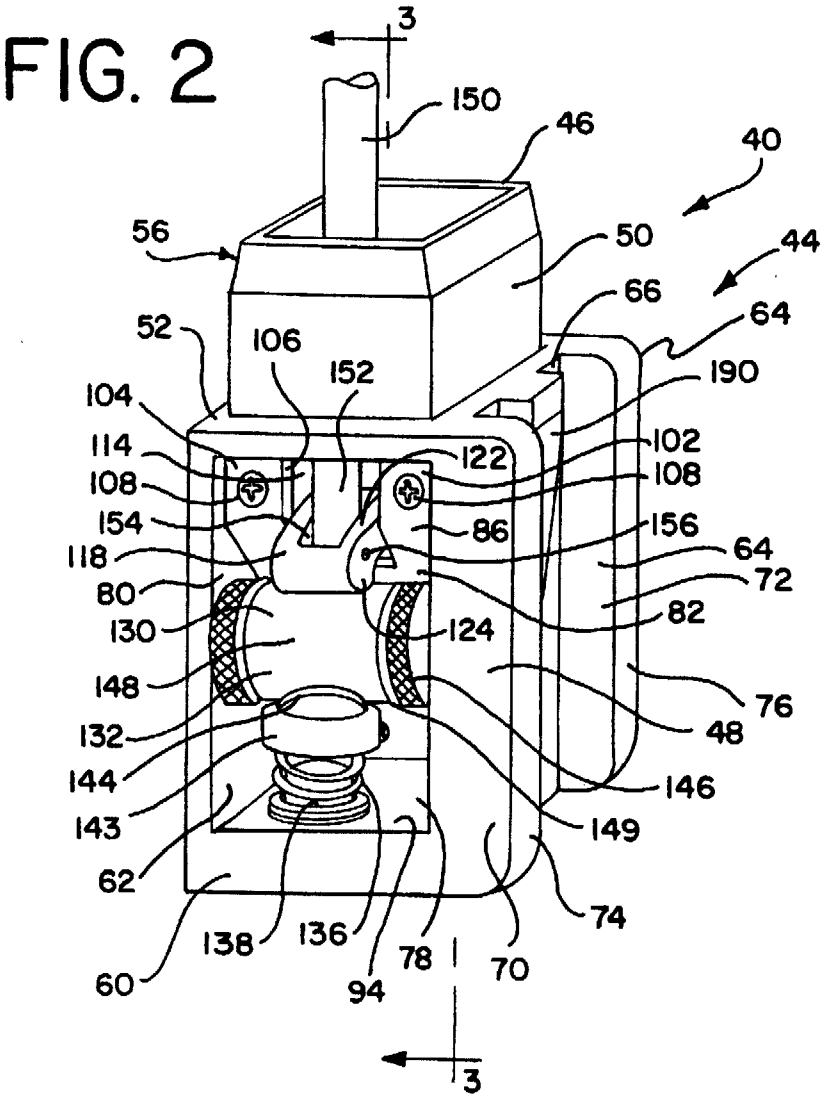
FIG. 2 is a perspective view of the present locking mechanism.
Figure 4:
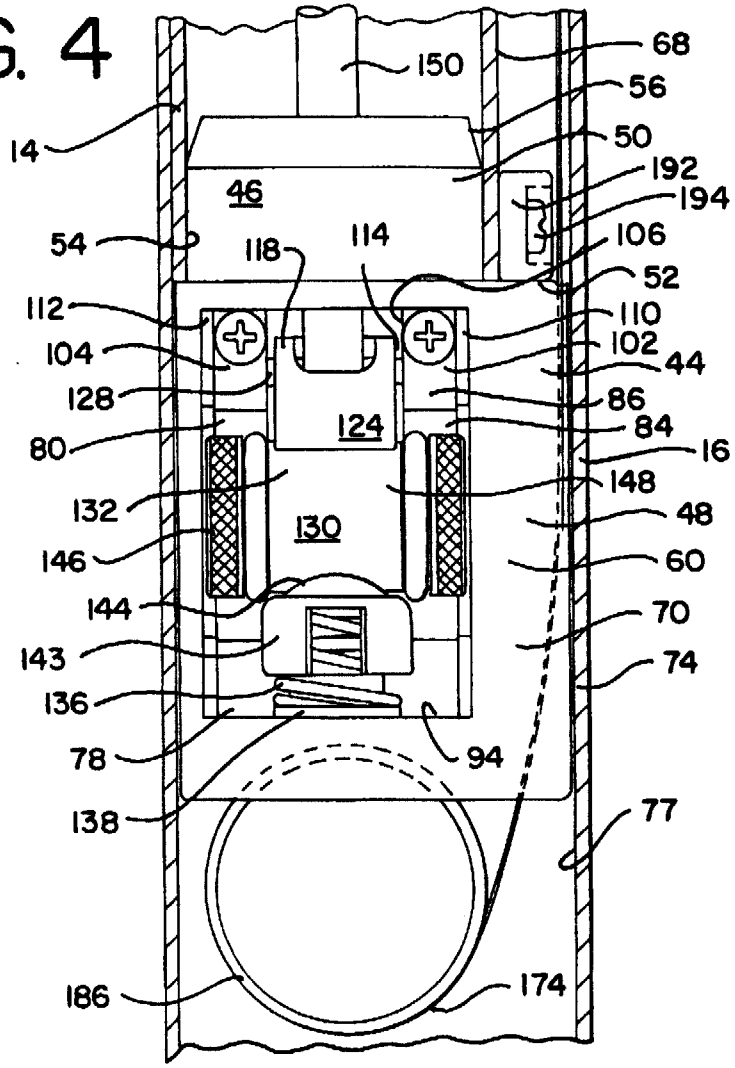
FIG. 4 is an enlarged fragmentary view of the locking mechanism illustrated in FIG. 1.

Referring now to FIGS. 2, 3, and 4, the present locking mechanism, generally designated 40, includes a housing 44 with an upper insert portion 46 and a lower portion 48. The insert portion 46 includes a rectangular sidewall 50 projecting vertically from an upper shoulder surface 52 of the lower portion 48 and is configured to provide an interference fit into a lower open end 54 of the inner tube 14 as shown in FIGS. 3 and 4. The upper end of the projecting sidewall 50 has an inwardly tapering chamfer 56 to aid in the assembly of the insert portion 46 into the lower end 54. A boss 58 with a bore 59 (best seen in FIG. 3), molded into the sidewall 50, provides a reinforced area in the sidewall for receiving a threaded fastener (not shown) or other fastener to further fix the housing 44 to the inner tube 14.

Referring now to FIG. 2, the lower portion 48 of the housing 44 is configured to slidably engage the interior of the outer tube 16. A front wall 60, a first sidewall 62, a back wall 64, and a second sidewall 66 depend from the shoulder surface 52. The width of the shoulder surface 52 is preferably equal to or greater than the thickness of the wall of the inner tube 14 to provide the lower end 54 a satisfactory bearing surface. Therefore, once inserted into the inner tube 14, the walls 62 and 66 are generally flush with an outer surface 68 of the inner tube, while the walls 60 and 64 extend beyond the periphery of the inner tube (best seen in FIG. 4).

Walls 60 and 64 include parallel fin-like bearing surface portions 70 and 72 extending laterally and in the same plane as the wall 60 and the wall 64, respectively. Corresponding outer edges 74 and 76, of the bearing surface portions 70 and 72, slidingly engage the inner wall 77 of the outer tube and provide a bearing surface for quiet and smooth slidable engagement of the inner tube 14 within the outer tube 16. With this goal of slidability in mind, the housing 44, and specifically the edges 74, 76, are dimensioned to closely fit within the inner dimensions of the outer tube 16, while maintaining the desired slidable relationship. The housing 44 is preferably made of polyethylene, however it is contemplated one skilled in the art will be aware of a number of materials that provide the desired rigidity and low friction properties of the housing 44.

The front wall 60 has an opening 78, which when the inner tube 14 is engaged with the outer tube 16, is adjacent to the inner wall 77 of the outer tube 16. A locking chamber 80 is defined by the inner wall 77, and a ramp 82 (best seen in FIG. 3) having a surface 84 facing generally towards the opening 78. The ramp 82 is preferably made of carbon steel or other rigid, durable material, and includes an upper vertical portion 86 horizontally offset from a lower vertical portion 88 such that the surface 84 is inclined between the upper portion 86 and the lower portion 88 to define an angle $\alpha$ (best seen in FIG. 3). In the preferred embodiment, the angle $\alpha$ is in the range of about 12° to 16°, depending on the material used and the coefficient of friction between the two materials (e.g. the steel of the ramp, and rubber of a locking element described below). Therefore, the chamber 80 is generally wedge-shaped when viewed from the side (FIG. 3), and is narrower between the opening 78 and the upper vertical portion 86 than between the opening 78 and the lower vertical portion 88.

A biasing platform 94 defines a bottom wall of the housing 44 and, as shown in FIG. 3, a corner block 96 is preferably integrally molded with or otherwise becomes part of the housing 44 at the intersection of the biasing platform 94 and the sidewall 64. Secured to the corner block 96 by at least one screw 100 is the lower vertical portion 88 of the ramp 82.

Referring now to FIGS. 2 and 4, the upper vertical portion 86 of the ramp 82 consists of two upwardly directed parallel tab-like members 102 and 104 which define a vertical slot 106, open at the top of the ramp 82 and extending into the surface 84 of the ramp. The members 102 and 104 are secured with fasteners such as screws 108 to first and second upper corner pieces 110 and 112, which are preferably integrally molded or otherwise secured to the sidewalls 62 and 66 and the back wall 64 in the upper rear corners of the lower portion 48 of the housing 44. Alternatively, the ramp 82 can be insert molded into the housing 44.

Referring now to FIGS. 2–4, between the corner pieces 110 and 112 is defined a horizontal rearwardly directed channel 114 which is in communication with the slot 106. A dog-legged shaped pivot arm 118 with a pivot end 120 (best seen in FIG. 3) is loosely received within the channel 114 and has an elbow 122 intermediate the pivot end 120 and a downwardly angled pushing end 124 extending through the slot 106. A through bore 126 in both corner pieces 110, 112 receives a first pivot pin 128 which also passes through bore 126 in the pivot end 120. This arrangement allows the pivot arm 118 to pivot about the pin 128 in the channel 114 and the slot 106.

A cylindrical locking element 130 with a circumferential face 132 is disposed in the chamber 80 and is captured between the sidewalls 62 and 66 so that the locking element is free to roll about its longitudinal axis within the chamber. A biasing helical spring 136 is preferably positioned underneath the locking element 130 on an upwardly projecting knob 138 on the platform 94 between the lower vertical portion 88 and the opening 78. The knob 138, which includes a chamfer 140 at the top for easy engagement with the spring 136, has a depending dowel 141 which is press fit into a bore 142 of the platform 94. A plastic spring cap 143 is located on the upper end of the spring 136 to terminate noise and reduce friction between the cylindrical locking element 130 and the spring 136, as would occur if the rotating element 130 turning cylinder contacted the spring 136. If the shape of the spring 136 deviates under a load from the cylindrical, it eliminates possible contact between spring and the inner wall 77 of the outer tube 16 as well. Two bosses 144 (best seen in FIG. 3) on the top of the spring cap facilitate the assembly of the element 130 and allow some room for horizontal movement of the element 130 as well.

The spring 136 biases the locking element 130 toward the narrow part of the chamber 80 and, more specifically, against the inner wall 77 (through the window 78) and the ramp surface 84. In this position, the locking element 130 is jammed against the inner wall 77 and the ramp surface 84, which prevents the inner tube 14 from moving downwardly within the outer tube 16. The relative positions of the telescoping inner and outer tubes 14, 16 are thus locked in place. It is contemplated that the components including the opening 78, the ramp 82, the knob 138 and the spring 136 may be rearranged in the housing 44 so that the locking element 130 is biased from another direction, such as from the side, instead of below, as is depicted here.

In the preferred embodiment shown in FIGS. 2 and 4, the face 132 of the locking element 130 has knurled end portions 146, while the face 148 intermediate the end portions is smooth. The knurled end portions 146 provide a friction surface for enhanced grab between the locking element 130, the inner wall 77 and the ramp face 84. A pair of rubber O-rings 149 are preferably installed into corresponding grooves on both ends of the locking element 130 for quiet and smooth performance during movement. The O-rings preferably project radially from the element beyond the friction surface 146.

When the element 130 is released from the locking position by a downward force from the pivot arm 118, it rolls, maintaining contact with the outer tube's inner surface 77 and the ramp 82 through the O-rings 149. When the pivot arm 118 is released from the unlocked position, an initial locking action between the element 130, the surface 77 and the ramp 82 is maintained by the rubber O-rings in a quick and smooth fashion. As is well known, the coefficient of friction for rubber is much greater than for steel. If any additional downward load applies, the O-rings 149 are compressed into the grooves and the knurled edges 146 of the element 130 are wedged and locked against the outer tube 16 in a position chosen by the user.

Also, it should be understood that the locking element 130 can be a different shape in order to conform to the shape of the cross section of the outer tube 16. For example, if the outer tube 16 were cylindrical, the locking element 130 would be barrel-shaped, with smaller diameter cross-sections at its ends relative to its central portion.

Referring again to FIGS. 2–4, contacting the middle area 148 of the face 132 of the element 130 is the pushing end 124 of the pivot arm 118. A push rod 150 has a lower end 152 received within a longitudinal slot 154 in the arm 118 at the elbow 122. A transverse bore 156 in the arm 118 (best seen in FIG. 3) and a corresponding bore in the lower end 152 of the push rod 150 receive a second pivot pin 158 which defines a second pivot point for the arm 118. Therefore, the arm 118 and the push rod 150 act as a cantilever system. When the push rod is moved downwardly, the arm 118 pivots about both the first pivot pin 128 and, through the action of the second pivot pin 158, the pushing end 124 pushes the locking element 130 to overcome the force of the spring 136. Thus, the element 130 is moved out of engagement with at least one of the inner wall 77 and the ramp surface 84.

Once the locking element 130 is pushed away from contact with at least one of these surfaces, the inner tube 14 can move reciprocally within the outer tube 16. In this manner, the locking action of the locking element 130 is released.

As shown on FIG. 1, the push rod 150 has an upper end 160 extending out of the upper end 34 of the inner tube 14 and into the support tube 31. In the preferred embodiment, to tighten tolerances, reduce noise, and to act as a bearing, a grommet-like plastic bushing 161 surrounds the end 160. The push rod 150 is actuated at the upper end 160 by a handle 162 which includes a grip 164, a pivot portion 166 and a lever portion 168. A bore 170 in the pivot portion corresponds with a similar bore in the sidewall 32 of the channel 30 to receive a third pivot pin 172. The lever portion 168 rests upon the upper end 160 of the push rod 150.

In operation, upward actuation of the grip 164 pivots the lever portion 168 downwardly against the upper end 160 and, by the mechanism described above, the downward motion of the push rod 150 overcomes the force of the springs 136 and pushes the locking element 130 away from at least one of the inner wall 77 and the ramp surface 84.

Referring now to FIGS. 1 and 4, in order to bias the platform 22 against gravity and make it easier for a user to raise the platform, a commercially available constant force spring 174 is seated beneath the housing 44. The spring 174, preferably a flat wound spring, is attached at its uncoiled elongated end 176 to a block-like second bearing surface 178, preferably made of a rigid, yet low friction material such as polyethylene, or other equivalent materials. The second bearing surface 178 is fastened to the inner wall 77 at an upper end 180 of the outer tube 16 preferably by two screws 182 or their equivalent. The elongated end portion 176 is attached to the bearing surface by a rivet 184 or other suitable fastener.

A coiled portion 186 of the spring 174 is nested beneath the housing 44 between lower depending portions 187 and 188 (best seen in FIG. 3) of the front wall 60 and the back wall 64, respectively. A downwardly narrowing wedge-shaped guide block 190 (best seen in FIG. 2) molded as part of the sidewall 66 limits the wobble of the elongated end 176 to prevent noise during the movement of the inner tube 14 in the outer tube 16.

The elongated end 176 is guided by the bearing surfaces 74 and 76, which prevent lateral tension from the spring 174 as it biases the inner tube 14 to the extended telescoped position and against gravity. Consequently, the spring 174 neutralizes the total weight of all of the moving parts of the housing 44 and internal components, which are attached to the inner tube 14. The tension of the spring 174 can be chosen so that the gravitational force on the platform 22 is slightly greater than the opposing force generated by the spring 174, thereby preventing the spring from forcing the inner tube 14 toward the extended position while still allowing for easy raising of the table. The second bearing surface 178 at the upper end of the tube 16 provides a second surface for the inner tube to ride upon which ensures smooth and quiet operation of the table.

A resilient bumper 192 is attached to the lower inner tube end 54 by at least one screw 194, makes permanent contact with upper sides of the housing walls 60 and 64, and actually rests on them. The bumper 192 is preferably made of rubber or equivalent plastic material and is attached to the housing 44 for softer engagement between the upper bearing 178 and the housing in the upper limit position, as well as easier unlocking action, when table is in an upper limit position and extreme load is applied, because of compressibility of the bumper. In fact, the positioning of the bumper actually prevents the inner tube from reaching its fully extended position for easier release of the locking mechanism.

When the table gets extracted all the way upward, the inner tube 14 is in the fully extended position, and the rubber bumper 192 becomes squeezed between upper sides of housing walls 60 and 64 and lower sides of the upper bearing 178. The rubber bumper smoothly stops upward movement of the inner tube 14 in the upper limit position. It has been found that when an extreme downward load is applied to the table top without the rubber bumper in the upper limit position, a significant force was required for unlocking. The rubber bumper 192 eliminates a stiff stop and allows for easy release of the locking element 130, because only a small movement upward unlocks the mechanism.

One of the primary features of the present invention is that the locking element 130 is under a constant load from the biasing spring 136. This feature provides for a positive locking system such that deactivation of the handle 162 immediately locks the inner tube 14 relative to the outer tube 16 without an echo effect. Also, since the locking element is cylindrical, it does not dent or otherwise deform the inner wall 77 or the ramp surface 84. This allows for smooth and quiet operation throughout the lifetime of the medical table.

While a particular embodiment of the selective vertical locking mechanism for telescoping tubes has been shown and described, it will be appreciated by those skilled in the art that changes and modifications may be made thereto without departing from the invention in its broader aspects and as set forth in the following claims.

We claim:

1. A locking mechanism for locking the relative position of inner and outer telescoping tubes, said locking mechanism comprising:

an inner tube and an outer tube, said outer tube having an inner wall and said inner tube having a first end and a second end opposite the first end, said inner tube being slidably engaged for reciprocal movement within the outer tube, between an extended position and a retracted position;

a housing fixed to the first end of said inner tube and having an opening adjacent said inner wall;

an inclined ramp fixed in said housing to define a generally wedge-shaped locking chamber with a portion of the inner wall adjacent said opening, said chamber having a wide end and a narrow end;

at least one locking element disposed in said chamber to contact said ramp and to engage said inner wall through said opening, thereby preventing said inner tube from sliding within said outer tube in at least one direction; and biasing means disposed in said chamber for urging said locking element against said ramp and said inner wall.

2. The locking mechanism according to claim 1 wherein said biasing means is a spring engaged at a first end on a biasing platform of said housing disposed at said wide end of said chamber.

3. The locking mechanism according to claim 2 further including a cap configured for engagement upon a second end of said spring opposite said first end, and on said spring where said spring engages said locking element.

4. The locking mechanism according to claim 1 further comprising a means for disengaging said locking element from at least one of said ramp and said inner wall thereby allowing said inner tube to slide in said at least one direction.

5. The locking mechanism according to claim 4 wherein said means for disengaging said locking element is a push rod having a first end and a second end, said second end of said push rod being actuable from said second end of said inner tube.

6. The locking mechanism according to claim 5 wherein said means for disengaging said locking chamber further comprises a pivot arm pivotal about an axis fixed within said housing upon actuation of said push rod to move said locking element away from at least one of said inner wall and said ramp.

7. The locking mechanism according to claim 6 wherein said pivot arm has a pushing end, a pivot end and an elbow, said pushing end being in contact with said locking chamber, said pivot end defining a pivot point for said arm for pivoting about said fixed axis, and said elbow being engaged with said first end of said push rod whereby the vertical actuation of said push rod pivots said arm about said axis and said pushing end pushes said locking element away from one of said inner wall and said ramp.

8. The locking mechanism according to claim 1 wherein said housing further has at least one bearing wall slidably engaged with said inner wall of said outer tube.

9. The locking mechanism according to claim 1 further comprising a means for biasing said inner tube towards the extended position.

10. The locking mechanism according to claim 9 wherein said means for biasing said inner tube is a biased return having a metal strip with a coiled portion and an elongated portion with an end portion, said coiled portion being in communication with said housing and said end portion being attached to said outer tube by means of an upper bearing element.

11. The locking mechanism according to claim 1 wherein said at least one locking element comprises a cylinder having a circumferential face with opposite end portions and a middle portion, said opposite end portions defining a friction surface on said face and said middle portion being smooth on said face.

12. The locking mechanism according to claim 11 wherein said friction surface is knurled.

13. The locking mechanism according to claim 11 further including a pair of O-rings disposed on said at least one locking element respectively on said end portions.

14. The locking mechanism according to claim 13 wherein said O-rings project radially beyond said friction surface.

15. The locking mechanism as defined in claim 1 further including a resilient bumper disposed on said housing for engaging an upper end of said outer table.

16. The locking mechanism according to claim 1 wherein said ramp is disposed at an incline in the range of 12–16° from vertical.

17. A medical overbed table comprising:

a stand;

an outer tube mounted to said stand and having an inner wall;

a platform;

an inner tube slidably engaged for reciprocal movement between an extended position and a retracted position within said outer tube, said inner tube having a lower end within said outer tube, and an upper end portion exterior to said outer tube, said upper end being mounted to said platform;

locking means for locking said inner tube to said outer tube thereby preventing said platform from moving downward;

a push rod for releasing said locking means to unlock said inner tube from said outer tube, said push rod having an upper end, and a lower end in communication with said locking means; and actuation means for actuating said push rod, said actuation means being actuable from said upper end portion and in communication with said upper end of said push rod, whereby actuation of said actuation means pushes said push rod to unlock said inner tube;

wherein said locking means further includes:

a housing fixed to said lower end of said inner tube and having an opening adjacent said inner wall;

an inclined ramp fixed in said housing to define a locking chamber with a portion of said inner wall adjacent said opening, said chamber having a wide end and a narrow end;

at least one locking element disposed in said chamber, said element being releasably urged against said ramp and through said opening against said inner wall thereby preventing said inner tube from sliding downwardly within said outer tube;

biasing means disposed in said chamber for urging said locking element against said ramp and said inner wall; and an arm in communication with said lower end of said push rod and said locking chamber to move said locking element away from at least one of said ramp and said inner wall upon actuation of said actuation means.

18. The medical overbed table according to claim 17 wherein said actuation means is a handle having a gripping portion, a lever portion and a pivot point intermediate said gripping portion and said lever portion and being pivotal about a generally horizontal axis in operational relation with said end portion of said inner tube such that upward movement of said gripping portion pivots said lever portion to move the push rod downwardly.

19. The medical overbed table according to claim 17 wherein said biasing means for urging said locking element against said ramp and said inner wall is a spring engaged at one end on a biasing platform of said housing at said wide end of said channel.

20. The medical overbed table according to claim 17 wherein said housing further has at least one bearing wall slidably engaged with said inner wall.

21. The medical overbed table according to claim 17 wherein said platform has an upper surface provided with at least one recess for retaining articles therein.

22. A telescoping apparatus with a selective locking mechanism comprising:

an outer tube having an inner wall;

an inner tube slidably engaged for reciprocal movement within said outer tube between an extended position and a retracted position;

a locking chamber associated with said inner tube having an opening adjacent said inner wall and an inclined ramp, said chamber having a wide end and a narrow end;

a locking element disposed in said chamber and being releasably urged toward said narrow end, against said ramp and against said inner wall through said opening thereby preventing said inner tube from sliding within said outer tube in at least one direction;

a biasing means disposed in said chamber for urging said locking element toward said narrow end;

means for disengaging said locking chamber from at least one of said ramp and said inner wall thereby allowing said inner tube to slide in said at least one direction;

return biasing means for biasing said inner tube toward said extended position upon release of said locking element by said disengaging means;

a stop on said outer tube for limiting the extended travel of said inner tube relative to said outer tube; and a bumper provided to said inner tube and associated with said locking chamber so that as said return biasing means pushes said inner tube toward said stop, said bumper impacts said stop.

23. The apparatus according to claim 22 wherein said bumper is arranged relative to said locking chamber to prevent said inner tube from reaching its fully extended position.

* * * * *